US006481637B1

(12) United States Patent
McQueen

(10) Patent No.: US 6,481,637 B1
(45) Date of Patent: Nov. 19, 2002

(54) RAIL PAD AND METHOD FOR STRAIN ATTENTUATION

(76) Inventor: Philip Jeffrey McQueen, 2 Bedford Cove, San Rafael, CA (US) 94901

( * ) Notice: Subject to any disclaimer, the term of this patent is extended or adjusted under 35 U.S.C. 154(b) by 0 days.

(21) Appl. No.: 09/716,387

(22) Filed: Nov. 20, 2000

(51) Int. Cl.[7] ..... E01B 19/00
(52) U.S. Cl. ..... 238/283; 238/382
(58) Field of Search ..... 238/8, 283, 382, 238/349, 351; 428/98, 116, 119, 131, 136, 166, 188

(56) References Cited

U.S. PATENT DOCUMENTS

| | | | | | |
|---|---|---|---|---|---|
| 427,814 | A | * | 5/1890 | Wallace | 238/283 |
| 695,429 | A | * | 3/1902 | Gombar | 238/283 |
| 2,088,113 | A | * | 7/1937 | Madison | 238/283 |
| 2,609,991 | A | * | 9/1952 | Jones | 238/283 |
| 2,656,116 | A | * | 10/1953 | Protzeller | 238/283 |
| 4,648,554 | A | * | 3/1987 | McQeen | 238/283 |
| 5,195,679 | A | * | 3/1993 | Leeves et al. | 238/283 |
| 5,203,501 | A | * | 4/1993 | Vanotti | 238/282 |
| 5,335,850 | A | * | 8/1994 | Igwemezie | 238/283 |
| 6,045,052 | A | * | 4/2000 | Besenschek | 238/382 |

FOREIGN PATENT DOCUMENTS

WO WO97/45592 * 12/1997

* cited by examiner

*Primary Examiner*—Mark T. Le
(74) *Attorney, Agent, or Firm*—Risto A. Rinne, Jr.

(57) ABSTRACT

An apparatus for use as a pad and for placement intermediate a rail and a railroad tie includes a plurality of cylindrical recesses that extend into the pad. An elastomeric material is used to form the pad. The cylindrical recesses may include a tiered structure, a portion of which is aligned with at least one corresponding cylindrical recess that is disposed on an opposite side of the pad. The cylindrical recesses convert vertical loading into shear forces that are distributed within the pad. Deformation of the pad due to shear and Poisson's ratio occurs substantially within the pad itself thereby lessening the horizontal movement, or scrubbing action, of the pad upon the railroad tie and increasing the life expectancy of the pad and also providing a method for strain attenuation by the use of shear.

17 Claims, 3 Drawing Sheets

RAIL PAD AND METHOD FOR STRAIN ATTENTUATION

BACKGROUND OF THE INVENTION

1. Field of the Invention

The present invention, in general relates to rail pads and, more particularly, to rail pads that lessen abrasion of a concrete railroad tie.

Rail pads are typically placed intermediate each of the rails and each railroad tie. The railroad ties may be concrete or steel or other material. In general, the use of rail pads is well known in the railroad arts.

They are used to dampen the changes in loading that occur on the rails. This is sometimes referred to in the industry as "strain attenuation". Rail pads are also used to provide electrical isolation sufficient to electrically insulate the rail from the railroad tie and they also serve to lessen abrasion of the railroad ties. The industry term for this detrimental phenomenon is "rail-seat abrasion" and it is discussed in greater detail hereinafter.

These types of benefits are well known and are not elaborated herein other than to state that rail pads are generally required devices and that an improvement appertaining to any of these areas is desirable.

The railroad industry has, over time, increased the use of concrete railroad ties (over pressure treated types of wood and other materials, such as steel) to support the rails thereon. Concrete railroad ties have advantages over their wood counterparts and over other possible types of materials that may be used to form the railroad tie that appertain, primarily, to issues of durability, availability, environment, toxicity, consistency, and especially, longevity (i.e., life-cycle cost) matters.

However, their use is not now without problems. Previous types of rail pads that are placed intermediate the rail and the tie were designed to absorb and dampen the changes in the loading that are experienced by the rails that they support. This change is known as dynamic loading and rail pads must effectively dampen dynamic loads.

Some of the prior art patents mentioned hereinafter describe the design and construction of such types of rail pads. These prior types of rail pads, while providing many benefits, fail to adequately solve the problem of rail-seat abrasion. This problem exists whenever a rail pad is placed intermediate a rail and any type of a railroad tie.

If a rail makes direct contact with a railroad tie, movement of the rail in response to changes in dynamic loading directly abrades the tie. If the railroad tie is made of concrete this problem is worsened.

Rail-seat abrasion also occurs when a rail pad is placed intermediate the rail and the tie. One of the factors that exacerbates rail-seat abrasion includes the effects of greater axle loading. Heavier and more powerful locomotives as well as the trend toward having railroad cars with a greater carrying capacity means a greater axle loading. Accordingly, the potential magnitude of change in the dynamic loading that the rail pad can experience is increasing.

Another factor is that sand from locomotives (for improving traction) settles down and further abrades the ties. This is discussed in greater detail hereinafter.

Another factor affecting rail-seat abrasion by increasing the effective dynamic loading is known as "rail roll" and this occurs on curves.

Rail-seat abrasion is affected as well by many other factors, such as the speed of the train, the trend toward greater annual tonnage, the radius of the curve, and other elements. In general, rail-seat abrasion is a vexing problem in the railroad arts.

Former types of rail pads, which are elastomeric, deform and then recover under the changing stress of dynamic loading, such as occurs when the numerous axles of a train apply a compressive loading to the pads and then as each axle successively passes by until the next axle once again repeats the loading process.

The deformation of an elastomer (within the elastic limit) is well known in the mechanical arts. Compression of an elastomer inevitably results in its lateral deformation. The amount of this deformation is mathematically expressed by Poisson's ratio where Poisson's ratio is equal to the unit lateral deformation divided by the unit longitudinal deformation. Average values of Poisson's ratio may then be calculated for any type of material.

When an elastomeric object, such as a rail pad, experiences a downward (i.e., a vertical) force applied thereto, such as when an axle of a rail car applies a load to the pad, it undergoes compression due to the load being vertically applied and it must, accordingly, expand in other directions. Therefore the pad will deform horizontally.

When the compressive force is withdrawn, that is when the axle of the rail car passes beyond the rail pad, the additional (i.e., dynamic) loading is removed causing the elastomeric rail pad to both rise (i.e., to decompress) and also to retract horizontally, again in reverse compliance with Poisson's ratio.

As there are many axles in both passenger and freight trains that periodically pass over each rail pad there is considerable back and forth horizontal motion of the rail pad that is occurring. Multiply this event times all of the railroad ties and then multiply that number by two, because there are two railroad pads per tie, (i.e., one at each rail) to obtain an idea of the scope of the problem, which extends to all railroad pads.

This type of motion in the railroad industry is known as "scrubbing" or sometimes as "scuffing". The rail pad literally scrubs that portion of the railroad tie upon which it rests. This scrubbing action eventually abrades the top of the rail tie at the rail-seat area.

Due to scrubbing, the concrete is abraded (i.e., worn) into a dust that is sloughed off and carried away by rain and wind, thereby forming an ever deepening (in depth) pocket in the railroad tie at the rail-seat into which the rail pad increasingly descends. Scrubbing abrades the rail pad as well, thereby also contributing to premature rail pad disintegration.

The scrubbing action of the railroad pad upon the tie, if allowed to persist unchecked, eventually reduces the concrete section at the rail-seat which in turn dramatically decreases the life expectancy of the concrete railroad tie. This necessitates the premature replacement of many such railroad ties.

Eventually, if left unattended, the rail itself may begin to make contact with the tie during times of maximal loading. This subjects the tie to unacceptable levels of stress and must be avoided. It also compromises the electrical insulation of the rail. It also has a deleterious influence on the longitudinal and lateral restraint aspects of the rail fastening system which are, in particular, essential for the proper securance of long-welded rails.

As the rail pad is required and as its dimensions are limited (i.e., its thickness is predetermined), the ties themselves must be replaced or repaired when they become sufficiently abraded (i.e., worn) by the scrubbing action of the rail pads.

It is a well known problem in the railroad industry to replace or repair an otherwise perfectly good concrete railroad tie that is no longer serviceable simply because it has been abraded by the horizontal scrubbing action of the rail pads. Attempts at rail-seat repair are also costly. In summary, rail-seat abrasion is a pervasive problem in the industry.

A satisfactory solution has not been forthcoming because it has been heretofore believed that there is no ideal way around the deleterious effects associated with Poisson's ratio. Various types of railroad pads attempt to ameliorate the problems of dynamic loading via compression of the elastomer but no satisfactory solution to the problem of "scrubbing" is presently known or available.

Pads of composite materials, dual-durometer materials, pads that are laminated and which include a steel-layer therein (three-layer pads), as well as pads having various other shapes, such as protrusions or embedded dimples, also do not completely solve the problem.

Certain of these rail pads, while they do lessen rail seat abrasion, are considerably more expensive to manufacture, for example dual-durometer and steel-layer types of pads.

The use of dimples is disclosed in a previously issued patent to the present inventor, and is identified in greater detail hereinafter in the listing of prior art references.

While dimples well provide for a rail pad that more effectively dampens the effects of loading, Poisson's ratio inevitably assures us that that loading will be translated into a scrubbing action that is exhibited by the bottom of the pad that is proximate the dimples upon the top surface of the railroad ties. Similarly, for all other techniques of creating a rail pad, Poisson's ratio will repeatedly change the horizontal dimensions of the pad sufficient to abrade (and degrade) the railroad tie in response to the dynamic loading that the pad experiences and thereby scrub the railroad tie upon which it is placed.

The scrubbing action not only causes premature wear of the railroad tie but also contributes to the premature wear of the pad itself. Accordingly, rail pads must be periodically replaced until, eventually, the tie itself may require replacement because of the protracted abrasion that is caused by the scrubbing action of the pads.

Clearly, it is desirable to extend the service life of both rail pads and railroad ties. Replacement of either the pad or the tie is labor intensive and therefore, quite expensive. Any significant improvement that extends the interval between which either the tie or the rail pad (or both) are replaced, is especially desirable.

Accordingly, there exists today a need for a cost-effective rail pad that provides effective elastomeric damping of the loading that is experienced by a rail and which decreases horizontal movement of the pad upon the railroad tie.

Clearly, a railroad pad that decreases scrubbing action would be a useful and desirable device. A method for accomplishing strain attenuation in a rail pad that minimizes scrubbing action is especially valuable.

2. Description of Prior Art

Rail pads and rail support systems are, in general, known. For example, the following patents describe various types of these devices:

U.S. Pat. No. 4,572,431 to Arato, Feb. 25, 1986;

U.S. Pat. No. 4,648,554 to McQueen, Mar. 10, 1987;

U.S. Pat. No. 5,110,046 to Young, May 5, 1992;

U.S. Pat. No. 5,261,599 to Brown, Nov. 16, 1993;

U.S. Pat. No. 5,549,245 to Kish, Aug. 27, 1996;

U.S. Pat. No. 5,551,632 to Kish, Sep. 3, 1996;

U.S. Pat. No. 5,551,633 to Kish, Sep. 3, 1996; and

U.S. Pat. No. 6,045,052 to Besenschek, Apr. 4, 2000.

While the structural arrangements of the above described devices, at first appearance, have similarities with the present invention, they differ in material respects. These differences, which will be described in more detail hereinafter, are essential for the effective use of the invention and which admit of the advantages that are not available with the prior devices.

OBJECTS AND SUMMARY OF THE INVENTION

It is an object of the present invention to provide a rail pad that decreases abrasion of a rail tie.

It is also an important object of the invention to provide a rail pad that increases the useful life of a rail tie.

Another object of the invention is to provide a rail pad that decreases abrasion of a concrete rail tie.

Still another object of the invention is to provide a rail pad that increases the life of a concrete rail tie.

Still yet another object of the invention is to provide a rail pad that increases the useful life of a rail pad.

Yet another important object of the invention is to provide a rail pad that reduces the horizontal movement of a rail pad during the application and removal of a dynamic load.

Still yet another important object of the invention is to provide a rail pad that is placed intermediate the top of a rail tie and the bottom of a rail and which reduces the horizontal scrubbing of the bottom of the rail pad upon the top of the rail tie that occurs during the application and subsequent removal of a dynamic load that is applied to the rail.

One other object of the invention is to provide a rail pad that creates shear within the pad as it transfers the load that is applied to the top thereof to a railroad tie that is disposed under the pad.

One further object of the invention is to provide a rail pad that deforms internally in response to a compressive load being applied thereto.

One additional object of the invention is to provide a rail pad that includes a plurality of cylindrical recesses that are disposed on one or more sides thereof.

One yet further important object of the invention is to provide a method for strain attenuation in a rail pad that minimizes scrubbing action upon a rail tie.

Briefly, a rail pad for use intermediate a rail and a rail tie that is constructed in accordance with the principles of the present invention has, preferably, a plurality of first cylindrical recesses that are disposed on either one or both planar surfaces (i.e., sides) of the rail pad. The longitudinal axes thereof are preferably normal with respect to the planar surfaces of the rail pad. Each of the first cylindrical recesses extends into the rail pad a predetermined depth and each of the first cylindrical recesses includes a first end that is disposed at the surface of the rail pad and a second end that is disposed distally with respect to the first end. The second end is disposed within the body of the rail pad and it includes a smaller diameter circular section that reduces the diameter of the first cylindrical recess by a predetermined amount. Each of the first cylindrical recesses connects with a second cylindrical recess that includes a smaller diameter than that of the first cylindrical recess. The second cylindrical recess extends further into the rail pad. The second cylindrical recess terminates within the rail pad at a distal end. Each of the first and second cylindrical recesses (i.e., those that are connected to each other) create an opening into the pad that is tiered (i.e., stepped), each opening having one step and two different diameter cylinders, or tiers. The cylindrical recesses are preferably disposed on both planar surfaces of the rail pad and are preferably offset with respect to each other so that a portion of the diameter of the first cylindrical recess that is disposed proximate a first planar surface of the rail pad aligns with a portion of the diameter of at least one of the second cylindrical recesses that are disposed proximate the second planar surface. The preferential orientation of the openings provides a method that converts compressive loading into shear stress upon the pad that results in a shearing action within the rail pad that lessens lateral deformation. Deformation of the rail pad due to shear and the effects of Poisson's ratio (due to some compression of the pad) occurs substantially within the pad itself, thereby minimizing horizontal movement of the pad (i.e., minimizing scrubbing). According to a first modification, the end of the second cylindrical recess is omitted and it is, instead, replaced by a second smaller diameter circular section that connects to a third cylindrical recess that extends even further into the rail pad which then provides an opening having two steps and three different diameter cylinders or tiers. According to a second modification, any of the second cylindrical recesses are eliminated which then provide an opening into the rail pad that includes only one diameter thereto.

DETAILED DESCRIPTION OF THE INVENTION

Figure 1:
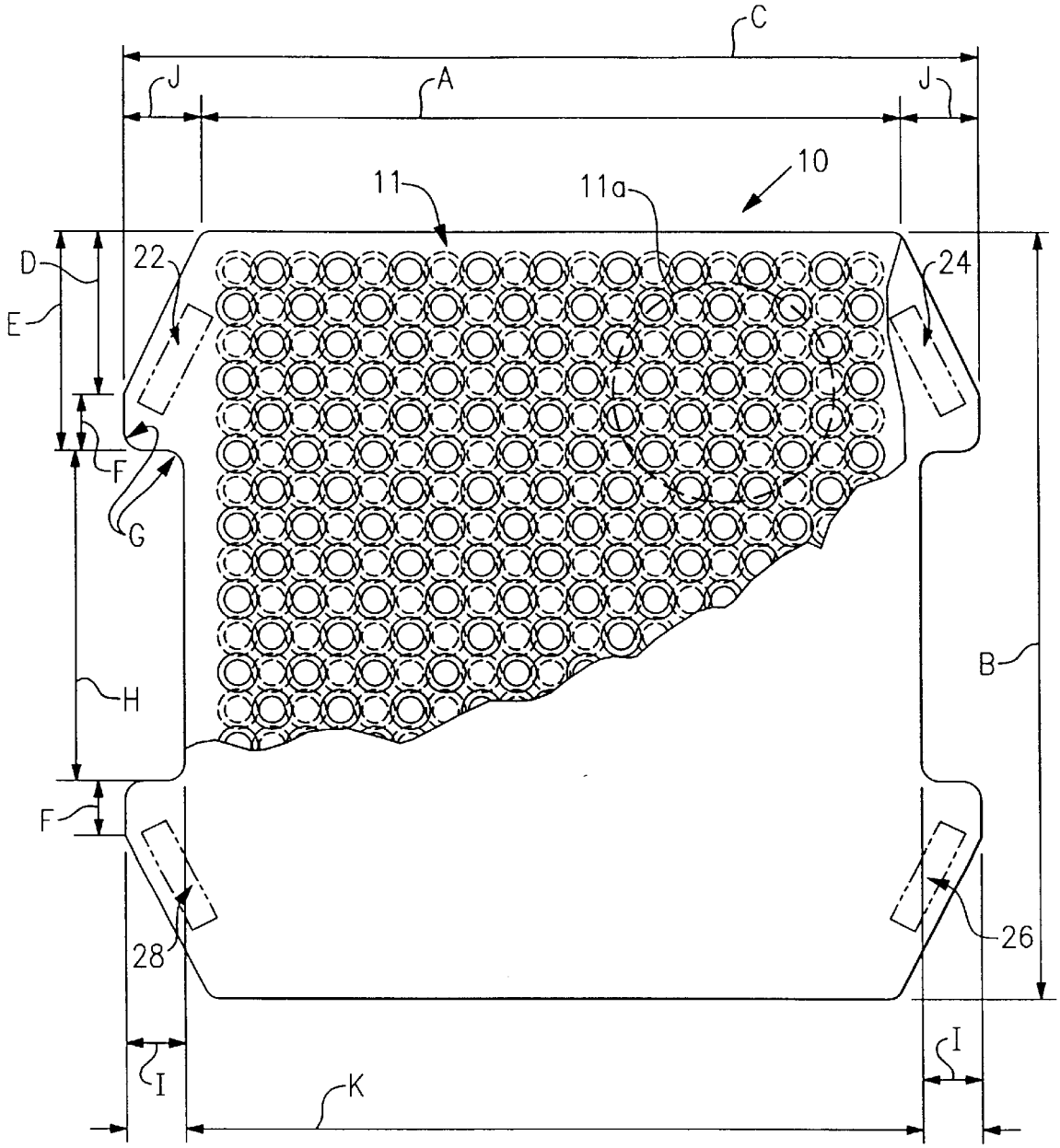
FIG. 1 is a top (plan) view of the preferred rail pad with a portion of the construction thereof shown.

Referring on occasion to all of the figure drawings and in particular now to FIG. 1 is shown, a rail pad, identified in general by the reference numeral 10.

The shape, configuration, and outer dimensions of the rail pad 10 are shown for a particular type of the rail pad 10 that is commonly referred to in the industry as the type for use with a "six inch base rail" and for one particular type of rail fastening hardware (not shown) that is well known in the art. The instant invention is adaptable for use with other sizes of rail pads (not shown) and for use with other types of rail fastening hardware (not shown).

The rail pad 10 is formed of any preferred elastomeric material having any preferred durometer. It is adaptable for use with layer rail pads (not shown) and with other types of rail pads (not shown). The rail pad 10 may be used with any modification that is, or shall become, known appertaining to rail pad construction and its use accordingly in other rail applications is anticipated along with various changes being made to any of the dimensions or materials used to form the rail pad 10. Those who possess ordinary skill in the design or manufacture of known types of rail pads (not shown) will, accordingly, benefit from the description herein and be able apply these teachings accordingly.

A plurality of cylindrical recesses, identified in general by the reference numeral 11, are included on both sides of the rail pad 10 and are described in greater detail hereinafter.

Figure 2:
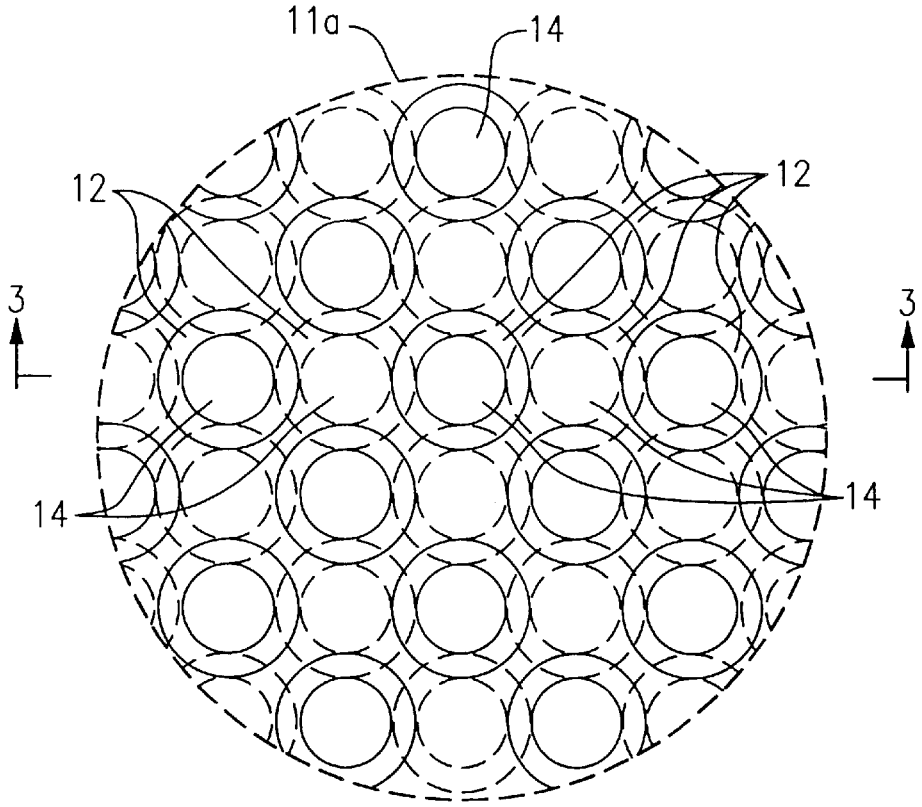
FIG. 2 is an enlarged plan view of a portion of the rail pad of FIG. 1 that is enclosed in a circle in FIG. 1.
Figure 3:
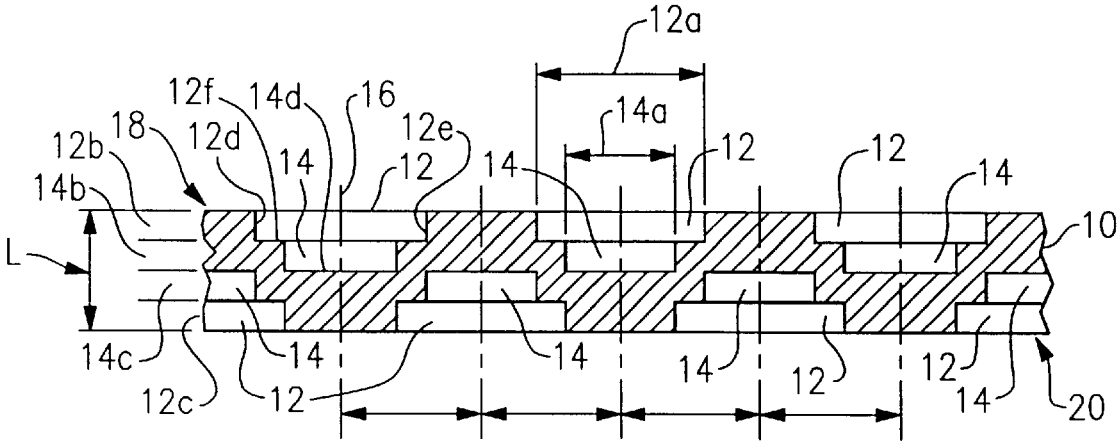
FIG. 3 is a cross sectional view taken on the line 3—3 in FIG. 2.

A portion of the cylindrical recesses 11 are shown within a circle 11*a* of FIG. 1. Referring also on occasion now to FIG. 2 is shown an enlarged plan view of the cylindrical recesses 11 that are contained within the circle 11*a*. Referring now also on occasion to FIG. 3 as well is shown a cross sectional view of the cylindrical recesses 11 of FIG. 2.

With regard to FIGS. 1 and 2, the solid circles indicate those cylindrical recesses 11 that are disposed on the plan (i.e., the visible) side of the rail pad 10 and the dashed circles indicate those cylindrical recesses 11 that are disposed on the opposite, rear side of the rail pad 10.

In the FIG. 1 drawing, the cylindrical recesses 11 are shown disposed over a portion of the surface of an active area of the rail pad 10. In actual construction of the rail pad 10, the pattern of cylindrical recesses 11 is continued throughout the entire active area of the rail pad 10.

A remaining portion of the cylindrical recesses 11 are omitted from the FIG. 1 drawing because the pattern of the cylindrical recesses 11 merely repeats itself throughout the active area of the rail pad 10. The active area includes that portion which is defined by the area contained within dimensions A times B, less a small perimeter (i.e., border) area that surrounds the active area. The small perimeter area preferably does not contain the cylindrical recesses 11 to optimally preserve the structural integrity of the rail pad 10 along its border.

A plurality of first cylindrical recesses 12 are preferably disposed on both sides of the rail pad 10 and each includes a predetermined diameter, as shown by arrow 12*a*. Each of the first cylindrical recesses 12 extends into the rail pad 10 a predetermined depth, as shown by space 12*b* and space 12*c*.

The preferred dimensions of the rail pad 10 (for use with the six inch base rail and the particular type of rail fastening hardware) as well as the depth and diameter of the cylindrical recesses 11 are discussed in greater detail hereinafter.

A plurality of second cylindrical recesses 14 are also preferably disposed on both sides of the rail pad 10. Each of the second cylindrical recesses 14 includes a predetermined diameter, shown by arrow 14*a* and a predetermined depth, shown by space 14*b* and space 14*c*.

Each of the second cylindrical recesses 14 is disposed adjacent to a corresponding first cylindrical recess 12 with which it shares a common longitudinal axis. A sample longitudinal axis 16 is typical of all of the longitudinal axes, and each is normal (preferably) with respect to a first planar surface of the rail pad 10, identified in general by the reference numeral 18.

A second planar surface 20 is disposed on an opposite side of the rail pad 10 and is parallel with respect to the first planar surface 18. Therefore, the sample longitudinal axis 16 is also normal (i.e., perpendicular) with respect to the second planar surface 20.

Each of the first and second cylindrical recesses 12, 14 combine together to form an opening that extends into the rail pad 10 a combined depth that is equal to the depth of the first cylindrical recess 12 plus the depth of the second cylindrical recess 14.

The depth of the opening that extends into the rail pad 10 from the first planar surface 18 side is equal to the depth of the first cylindrical recess 12*b* plus the depth of the second cylindrical recess 14*b* disposed on that side. The depth of the opening that extends into the rail pad 10 from the second planar surface 20 side is equal to the depth of the first cylindrical recess 12*c* plus the depth of the second cylindrical recess 14*c* disposed on that side.

The combined depth of any of the cylindrical recesses 11 must be less than the overall thickness of the rail pad 10 if maximum benefit through the use of shear (under load) is to be obtained, as is described in greater detail hereinafter. The preferred combined depth (i.e., the depth of the first cylindrical recess 12 plus the depth of the corresponding second cylindrical recess 14) of any of the cylindrical recesses 11 is one-half the thickness of the rail pad 10, as shown in FIG. 3.

Although any of the dimensions herein disclosed may be varied to suit the particular application at hand, it is anticipated that the dimensions of the first and second cylindrical recesses 12, 14 typically will be identical on both sides of the rail pad 10. If it is determined to be particularly advantageous the pattern, dimensions, and symmetry of the cylindrical recesses 11 may also be varied as preferred to suit the particular application at hand.

Study of the cylindrical recesses 11 that are disposed on the first planar surface 18 as compared with those that are disposed on the second planar surface 20 reveal that they are offset with respect to each other.

The cylindrical recesses 11 form what visually resembles a cylindrical honeycomb pattern on each side of the rail pad 10 wherein the cylindrical recesses 11 are preferably offset so that a portion of the inside diameter of the first cylindrical recess 12 that is disposed proximate the first planar surface 18 aligns with a portion of the inside diameter of second cylindrical recess 14 that is disposed proximate the second planar surface 20.

Similarly, a portion of the inside diameter of the second cylindrical recess 14 that is disposed proximate the first planar surface 18 aligns with a portion of the inside diameter of the first cylindrical recess 12 that is disposed proximate the second planar surface 20.

The opposite is also true, conversely that a portion of the inside diameter of the first cylindrical recess 12 that is disposed proximate the second planar surface 20 aligns with a portion of the inside diameter of second cylindrical recess 14 that is disposed proximate the first planar surface 18 and a portion of the inside diameter of the second cylindrical recess 14 that is disposed proximate the second planar surface 20 aligns with a portion of the inside diameter of first cylindrical recess 12 that is disposed proximate the first planar surface 18.

Accordingly, the 'honeycomb' pattern on the first planar surface 18 is offset with respect to the 'honeycomb' pattern on the second planar surface 20. The benefits derived from this particular orientation provide a method of strain attenuation by the use of shear within the rail pad 10 and are described in greater detail hereinafter.

Each of the first cylindrical recesses 12 includes a first end of the first cylindrical recess 12*d* that is on the same plane as either the first or second planar surfaces 18, 20.

Each of the first cylindrical recesses 12 includes a second end of the first cylindrical recess 12*e* that is disposed within the rail pad 10 distally with respect to the first end of the first cylindrical recess 12*d*.

Disposed at each of the second ends of the first cylindrical recesses 12*e* is a smaller diameter circular section 12*f* that reduces the diameter of the first cylindrical recess 12 to that equal to the diameter of the second cylindrical recess 14.

Each of the second cylindrical recesses 14 includes a distal end 14*d* that is disposed within the rail pad 10 distally with respect to the first end of the first cylindrical recess 12*d*.

Each of the first cylindrical recesses 12, when combined with a corresponding second cylindrical recess 14, forms a continuous opening (i.e., a void) that resembles a tiered-type of a wedding cake in appearance that extends into the rail pad 10 and terminates at the distal end 14*d*.

If desired, the second cylindrical recesses 14 may be omitted from any of cylindrical recesses 11 to produce a modified cylindrical recess (not shown) having only one diameter thereto.

Alternatively, if desired, a third cylindrical recess (not shown) may be added adjacent to any of the second cylindrical recesses 14. Similarly, any number of additional recesses (not shown) may also be added to create a void that resembles in appearance a tiered-type of a wedding cake having any number of layers (i.e., tiers) that are desired.

The preferred dimensions of the rail pad 10 for use with a six inch base rail for dimension A are 6.25 inches plus or minus tolerances (0.060 in.) and for dimension B are 7.0 inches plus or minus tolerances. Dimension C is 7.75 inches plus or minus tolerances. In all of the following instances, the dimensions given are in inches and plus or minus tolerances must also be added to the dimensions but the tolerances are not included in the descriptions for reasons of brevity and clarity.

Dimension D is 1.47; dimension E is 1.97; dimension F is 0.50; Radius G is 0.189R (for each radius); dimension H is 3.06; dimension I is 0.56; dimension J is 0.75; and dimension K is 6.63.

Dimension L (unloaded) is 0.256 plus or minus 0.005; and the dimensions for 12*b*, 14*b*, 14*c*, and 12*c* are each 0.064 (unloaded).

The rail pad 10 includes four spaces for identification purposes as is well known in the art. A first space 22 indicates the "pad type". A second space 24 indicates a cavity number. A third space 26 provides material identification. A fourth space 28 includes a manufacturer's identification.

The preferred inside diameter (ref. arrow 12*a*) for the first cylindrical recesses 12 is 0.375 and the preferred inside diameter (ref. arrow 14*a*) for the second cylindrical recesses 14 is 0.250. It is to be understood that all of the dimensions provided in this specification are variable. It is intended that any of these dimensions and spacing may be varied to optimally create any preferred characteristic for the rail pad 10.

Figure 4:
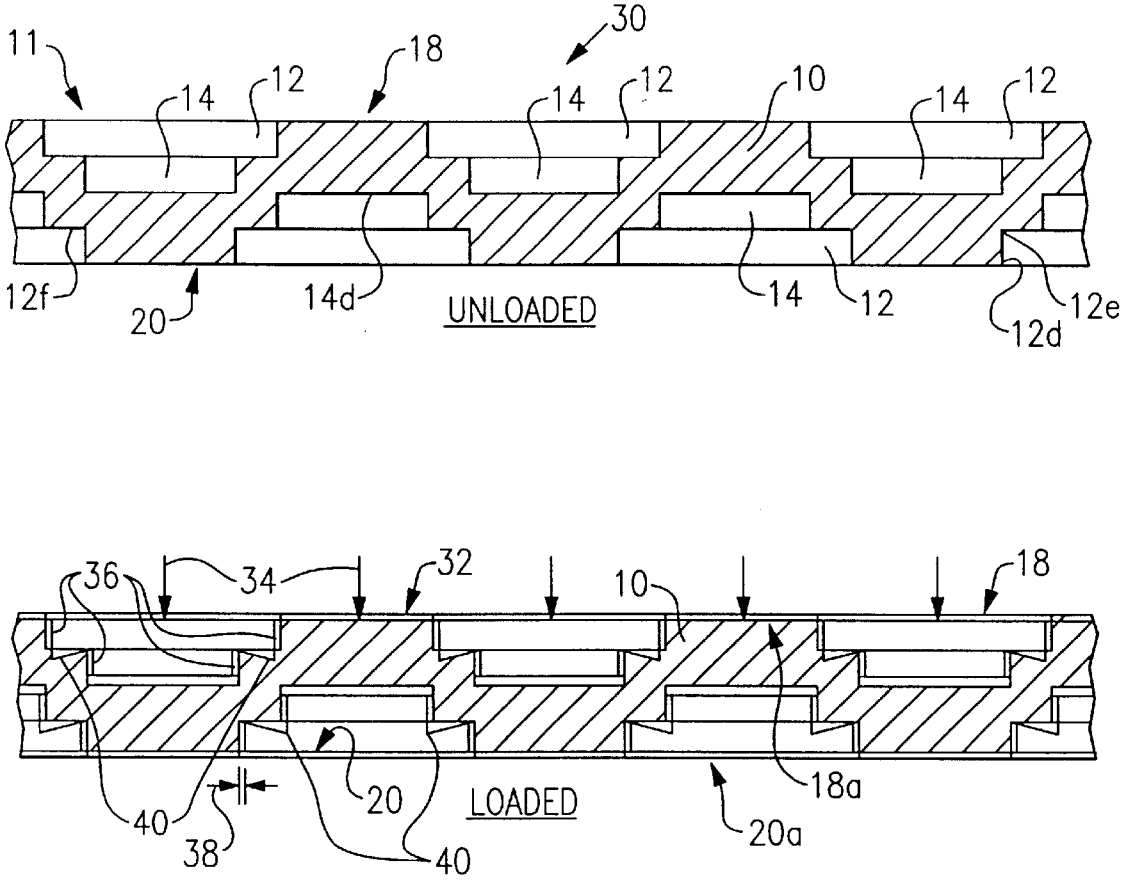
FIG. 4 shows a comparison of a portion of the rail pad of FIG. 1 in both an unloaded and a loaded condition.

Referring now also to FIG. 4 an upper view, identified in general by the reference numeral 30 shows the rail pad 10 without a substantial compressive load applied thereto intermediate the first and second planar surfaces 18, 20.

A lower view, identified in general by the reference numeral 32 shows the rail pad with substantial compressive load applied thereto. The load is shown by a plurality of arrows 34 that are tending to urge to first planar surface 18 in a downward direction, toward the second planar surface 20.

When the rail pad 10 is properly installed the second planar surface 20 is typically placed atop a rail tie (not shown). A steel rail (not shown) is placed atop the first planar surface 18 and the rail pad 10 and the steel rail are secured in position proximate (i.e. atop) the rail tie using hardware known to the art.

When a train (not shown) passes over the steel rail, the weight of the train bears down through the steel rail which, in turn, attempts to compress the rail pad 10 intermediate the steel rail above it and the rail tie underneath.

The lower view 32 shows a slightly displaced first planar surface 18*a* that is disposed slightly below the first planar surface 18 (shown also for purposes of comparison). A slightly displaced second planar surface 20*a* is also shown disposed slightly below the second planar surface 20 (shown for purposes of comparison).

Because the overall thickness of the rail pad 10 is reduced (it being formed of an elastomer) when it is under load, the material that is compressed must, according to Poisson's ratio, exhibit lateral deformation.

Instead of transferring the lateral deformation in substantial ways to the second displaced planar surface 20*a* (as occurs with certain types of prior art pads [not shown]), the interior portions of the cylindrical recesses 11 fill with material, as indicated by reference numeral 36. Accordingly, the interior portions of the cylindrical recesses 11 provides an area to accommodate the lateral deformation of the rail pad 10.

This, in turn, greatly reduces the amount of lateral deformation that occurs along the second displaced planar surface 20*a*. A lateral displacement dimension 38 reveals that very little scrubbing action of the rail pad 10 upon the rail tie occurs during loading and unloading of the rail pad 10.

Furthermore, strain reduction (i.e., attenuation), which is required of the rail pad 10, is accomplished internally in the pad by shear within the rail pad 10. The shear that occurs within the pad is shown, in general, by reference numeral 40. Shear action avoids (i.e., it prevents) further compression of the rail pad 10 from occurring and accordingly lessens the amount of material that must undergo lateral deformation.

Accordingly, a method of strain reduction that relies upon shear is provided that lessens the amount of elastomer within the rail pad 10 that undergoes compression (and the subsequent effects of Poisson's ratio.

Many factors not mentioned herein will affect the design of the rail pad 10. For example, certain parameters disclosed herein will vary in accordance with the primary usage of the rail (i.e., axle loads and yearly tonnage). Is the rail pad 10 intended to support primarily heavy freight or lighter passenger trains? What speed will the trains be traveling? The speed of the train is another factor that affects how the loading is applied to the rail pad 10.

This is because, in general, the compressive loading that is applied is not a simple vertical application of a load from an overhead location (with no lateral component) followed by its subsequent removal (as the train's axle passes beyond the rail pad 10).

The actual loading of the rail pad 10 is applied in a compressive wave (as the steel rail itself flexes during a progressive loading by the axle) and that wave that correlates with both the direction and the speed of the train. The speed and weight of the train will thereby affect the loading that is experienced by the rail pad 10 and, accordingly, many of its design attributes.

Also, rail curvatures subject the steel rail to lateral forces which tend to rotate the steel rail (about a longitudinal axis of the steel rail), thereby causing an uneven distribution of loading upon the rail pad 10. All of these factors are taken into account to modify the rail pad as desired for each intended application thereof.

For example, is well expected that the rail pad 10 can be constructed out of any preferred elastomeric material and that it may be modified to include any preferred elastomeric material, having any preferred durometer, whether monolithic or constructed as a laminate (i.e., having layers of material), using adhesives, or incorporating any of the benefits and attributes of any of the known prior types of pads (not shown).

The invention has been shown, described, and illustrated in substantial detail with reference to the presently preferred embodiment. It will be understood by those skilled in this art that other and further changes and modifications may be made without departing from the spirit and scope of the invention which is defined by the claims appended hereto.

What is claimed is:

1. A method of limiting the lateral displacement of an exposed surface of an elastomeric rail pad during loading of said rail pad, said rail pad including an active area having a first substantially planar surface and a second substantially planar surface that is disposed distally and in parallel planar alignment with respect to said first substantially planar surface, comprising the steps of:

(a) providing said rail pad having a cylindrical recess disposed in said active area on said first substantially planar surface, said cylindrical recess including a first end disposed at said first substantially planar surface and extending into said pad a predetermined amount and including at least one other cylindrical recess that is disposed in said active area on said second substantially planar surface and wherein a portion of an inside diameter of said cylindrical recess aligns longitudinally with a portion of an inside diameter of said at least one other cylindrical recess and wherein said cylindrical recess and said at least one other cylindrical recess each includes a center longitudinal axis and wherein said center longitudinal axis of said cylindrical recess is offset with respect to said center longitudinal axis of said at least one other cylindrical recess;

(b) placing said active area intermediate a rail and a tie; and (c) applying a compressive load to said rail pad, whereby a portion of a lateral deformation resulting from said compressive load is distributed in the space provided by said cylindrical opening in said rail pad.

2. An improved rail pad that includes an active area which is adapted to be disposed intermediate a rail and a tie, wherein the improvement comprises:

a cylindrical recess disposed in said active area and wherein said cylindrical recess includes an opening that is disposed in alignment with respect to a first planar surface of said active area and wherein each of said plurality of cylindrical recesses includes a first cylindrical recess having a predetermined diameter and a predetermined depth and wherein said first cylindrical recess includes a first end that is disposed on said first planar surface of said rail pad and extends from said first planar surface into said rail pad said predetermined depth and wherein said first cylindrical recess includes a second end that is disposed distally with respect to said first end and wherein each of said plurality of cylindrical recesses includes a second cylindrical recess having a predetermined diameter that is less than said predetermined diameter of said first cylindrical recess and wherein said second end of said first cylindrical recess includes a smaller diameter circular section that reduces the diameter of said first cylindrical recess to that of said second cylindrical recess that is attached thereto and wherein said second cylindrical recess combines with said first cylindrical recess to provide a continuous tiered opening that extends into said rail pad to a distal end of said second cylindrical recess.

3. A method of attenuating strain in a rail pad that includes an elastomeric material, comprising the steps of:

(a) providing said rail pad having a cylindrical recess disposed in an active area on a first substantially planar surface, said cylindrical recess including a first end disposed at said first substantially planar surface and extending into said pad a predetermined amount and including at least one other cylindrical recess that is disposed in an active area on a second opposite substantially planar surface and wherein a portion of an inside diameter of said cylindrical recess aligns longitudinally with a portion of an inside diameter of said at least one other cylindrical recess and wherein said cylindrical recess and said at least one other cylindrical recess each includes a center longitudinal axis and wherein said center longitudinal axis of said cylindrical recess is offset with respect to said center longitudinal axis of said at least one other cylindrical recess; and (b) placing said active area intermediate a rail and a tie; wherein subsequent to the application of a compressive load to said rail pad, a portion of said compressive load is manifest as shear within said rail pad sufficient to displace at least a portion of said one cylindrical recess with respect to at least a portion of said one other cylindrical recess along a longitudinal axis that is normal with respect to said first substantially planar surface.

4. An improved rail pad that includes an active area which is adapted to be disposed intermediate a rail and a tie, wherein the improvement comprises:

a plurality of cylindrical recesses disposed in said active area and wherein a portion of said plurality of cylindrical recesses are disposed on said first planar surface and a remaining portion of said plurality of cylindrical recesses are disposed on a second planar surface of said rail pad, said second planar surface being disposed on an opposite side of said rail pad with respect to said first planar surface and wherein a portion of an inside diameter of at least one of said plurality of cylindrical recesses that are disposed on said first planar surface aligns longitudinally with a portion of an inside diameter of at least one of said remaining portion of said plurality of cylindrical recesses that are disposed on said second planar surface and wherein each of said plurality of cylindrical recesses includes a center longitudinal axis and wherein said center longitudinal axis of said at least one of said plurality of cylindrical recesses that are disposed on said first planar surface is offset with respect to said center longitudinal axis of said at least one of said remaining portion of said plurality of cylindrical recesses that are disposed on said second planar surface.

5. The improved rail pad of claim 4 wherein each of said plurality of cylindrical recesses includes a first cylindrical recess having a predetermined diameter and a predetermined depth and wherein said first cylindrical recess includes a first end that is disposed on said first planar surface of said rail pad and extends from said first planar surface into said rail pad said predetermined depth and wherein said first cylindrical recess includes a second end that is disposed distally with respect to said first end.

6. The improved rail pad of claim 5 wherein each of said plurality of cylindrical recesses includes a second cylindrical recess having a predetermined diameter that is less than said predetermined diameter of said first cylindrical recess and wherein each of said second ends of said first cylindrical recess includes a smaller diameter circular section that reduces the diameter of said first cylindrical recess to that of said second cylindrical recess that is attached thereto and wherein said second cylindrical recess combines with said first cylindrical recess to provide a continuous tiered opening that extends into said rail pad to a distal end of said second cylindrical recess.

7. The improved rail pad of claim 6 wherein said plurality of first and second cylindrical recesses are disposed on said first planar surface of said rail pad.

8. The improved rail pad of claim 6 wherein said plurality of first and second cylindrical recesses includes a portion of said plurality of first and second cylindrical recesses that are disposed on said first planar surface and a remaining portion of said plurality of said first and second cylindrical recesses that are disposed on a second planar surface of said rail pad, said second planar surface being disposed on an opposite side of said rail pad with respect to said first planar surface.

9. The improved rail pad of claim 8 wherein said plurality of first and second cylindrical recesses on said first planar surface defines a pattern and wherein said plurality of first and second cylindrical recesses on said second planar surface defines a second pattern.

10. The improved rail pad of claim 9 wherein a center longitudinal axis passing through one of said cylindrical recesses of said first pattern is offset with respect to a second center longitudinal axis passing through any of said cylindrical recesses of said second pattern.

11. The improved rail pad of claim 10 wherein a portion of an inside diameter of said first cylindrical recess disposed on said first planar surface aligns longitudinally with a portion of the inside diameter of at least one of said second cylindrical recesses that is disposed proximate said second planar surface.

12. The improved rail pad of claim 11 wherein a portion of the inside diameter of said second cylindrical recess that is disposed proximate said first planar surface aligns longitudinally with a portion of the inside diameter of at least one of said first cylindrical recesses that is disposed proximate said second planar surface.

13. The improved rail pad of claim 9 wherein said first and said second pattern are a repeating pattern that extends substantially over said active area of said rail pad.

14. A rail pad, comprising:

(a) a base including an elastomeric material, said base having a predetermined overall length and overall width and overall thickness and wherein said thickness includes a first substantially planar surface on one side thereof and wherein a portion of said base is used to form an active area, said active area adapted to be disposed intermediate a rail and a tie; and (b) a cylindrical recess disposed in said active area on a first side of said base, said cylindrical recess including a first end disposed at said first substantially planar surface and extending into said thickness of said pad a predetermined amount and including at least one other cylindrical recess that is disposed in said active area on a second side that is opposite with respect to said first side and wherein a portion of an inside diameter of said cylindrical recess aligns longitudinally with a portion of an inside diameter of said at least one other cylindrical recess and wherein said cylindrical recess and said at least one other cylindrical recess each includes a center longitudinal axis and wherein said center longitudinal axis of said cylindrical recess is offset with respect to said center longitudinal axis of said at least one other cylindrical recess.

15. The rail pad of claim 14 including a plurality of said cylindrical recesses.

16. The rail pad of claim 15 wherein a portion of said plurality of cylindrical recesses are disposed on said first substantially planar surface.

17. The rail pad of claim 16 wherein said base includes a second side that is disposed opposite with respect to said first substantially planar surface and wherein a portion of said plurality of cylindrical recesses are disposed on said first side of said base and a remainder of said plurality of cylindrical recesses are disposed on said second side.

* * * * *

UNITED STATES PATENT AND TRADEMARK OFFICE

CERTIFICATE OF CORRECTION

PATENT NO. : 6,481,637 B1
DATED : November 19, 2002
INVENTOR(S) : Philip Jeffrey McQueen It is certified that error appears in the above-identified patent and that said Letters Patent is hereby corrected as shown below:

Title page,
Item [54], Title should read as follows: -- [54] RAIL PAD AND METHOD FOR STRAIN ATTENUATION. --
Item [56], References Cited, U.S. PATENT DOCUMENTS
"4,648,554 A * 3/1987 McQeen……..238/283" should read
-- 4,648,554 A * 3/1987 McQueen……..238/283 --

Signed and Sealed this

Tenth Day of August, 2004

JON W. DUDAS
*Acting Director of the United States Patent and Trademark Office*